US009899206B2

(12) United States Patent
Winkler et al.

(10) Patent No.: US 9,899,206 B2
(45) Date of Patent: Feb. 20, 2018

(54) METHOD OF PRODUCING A HALOGEN LAMP AND HALOGEN LAMP

(71) Applicant: vosla GmbH, Plauen (DE)

(72) Inventors: Markus Winkler, Tauerbischofsheim (DE); Martin Polster, Pausa (DE)

(73) Assignee: VOSLA GMBH, Plauen (DE)

( * ) Notice: Subject to any disclaimer, the term of this patent is extended or adjusted under 35 U.S.C. 154(b) by 0 days.

(21) Appl. No.: 14/932,114

(22) Filed: Nov. 4, 2015

(65) Prior Publication Data

US 2016/0126084 A1 May 5, 2016

(30) Foreign Application Priority Data

Nov. 4, 2014 (DE) ..... 10 2014 222 501

(51) Int. Cl.

| | |
|---|---|
| ***H01K 1/32*** | (2006.01) |
| ***H01K 5/00*** | (2006.01) |
| ***H01K 3/00*** | (2006.01) |
| ***H01K 7/02*** | (2006.01) |

(52) U.S. Cl.

CPC ..... *H01K 1/325* (2013.01); *H01K 1/32* (2013.01); *H01K 3/005* (2013.01); *H01K 5/00* (2013.01); *H01K 7/02* (2013.01)

(58) Field of Classification Search

CPC ..... H01K 1/325; H01K 5/00; H01K 3/005; H01K 7/02; H01K 1/32

See application file for complete search history.

(56) References Cited

U.S. PATENT DOCUMENTS

| | | | | |
|---|---|---|---|---|
| 5,660,462 | A | 8/1997 | Bockley et al. | |
| 5,666,017 | A | 9/1997 | McGuire | |
| 5,750,203 | A * | 5/1998 | Chung | C03C 17/009 427/380 |
| 6,720,081 | B2 | 4/2004 | Vitt et al. | |
| 7,169,441 | B2 | 1/2007 | Vitt et al. | |
| 2011/0089826 | A1 | 4/2011 | Hentschel et al. | |

FOREIGN PATENT DOCUMENTS

| | | | | |
|---|---|---|---|---|
| DE | 198 41 304 | A1 | 3/2000 | |
| DE | 69513259 | T2 | 4/2000 | |
| DE | 69703876 | T2 | 9/2001 | |
| DE | 102004038556 | A1 | 2/2006 | |
| DE | 10 2005 019 113 | A1 | 10/2006 | |
| DE | 10 2008 060 782 | A1 | 6/2010 | |
| DE | 10 2009 025 484 | A1 | 1/2011 | |
| DE | 102010042557 | A1 | 4/2011 | |
| DE | 10 2010 031 360 | A1 | 1/2012 | |
| DE | 202013009984 | U1 * | 11/2013 | H01K 1/32 |
| EP | 1248959 | A2 | 10/2002 | |
| WO | 2008/074657 | A2 | 6/2008 | |

OTHER PUBLICATIONS

German Search Report for German Patent Application No. 20 2013 009 984.4, dated May 22, 2014, 5 pages.

Office Action from German Patent Application 10 2014 222 501.9, dated Apr. 12, 2017, 10 pages.

* cited by examiner

*Primary Examiner* — Joseph L Williams

(74) *Attorney, Agent, or Firm* — Westman, Champlin & Koehler, P.A.

(57) ABSTRACT

The present invention relates to a method for producing a halogen lamp, including the following steps: providing a glass tube blanket; dip-coating of the glass tube blanket using a sol gel process having an inorganic coating; forming a lamp bulb from the coated glass tube blanket. The present invention relates further to a halogen lamp produced accordingly.

13 Claims, 4 Drawing Sheets

METHOD OF PRODUCING A HALOGEN LAMP AND HALOGEN LAMP

CROSS-REFERENCE TO RELATED APPLICATION

This Application is a non-provisional Application of German Application No. 10 2014 222 501.9, filed Nov. 4, 2014, in German, the contents of which are hereby incorporated by reference in their entirety.

TECHNICAL FIELD

The present invention relates to methods for producing a halogen lamp. The invention relates further to a halogen lamp.

BACKGROUND OF THE INVENTION

A halogen incandescent lamp and a method for producing the same is described in DE 10 2005 019 113 A1. The halogen incandescent lamp comprises a lamp bulb having a luminous element contained therein. Furthermore, the lamp bulb is at least partly covered by an IR radiation reflecting coating by which heat radiation emitted from the luminous element in addition to the visible light shall be reflected back onto the luminous element. The application of the IR radiation reflecting coating is performed after deformation of the lamp bulb, in particular after main deformation of the lamp bulb. Thus, a conventional halogen incandescent lamp is produced in a first step and is being coated subsequently.

With such a halogen incandescent lamp, rays emitted from the luminous element do not impinge on the IR radiation reflecting coating directly but have to pass the wall of the lamp bulb first whereby an unwanted offset of the rays occurs due to refraction, as well as absorption occurs due to attenuation. Furthermore, such a coating or layer provided externally on the lamp bulb may easily become scratched or be otherwise damaged by external impact since the coating is not protected by the lamp bulb.

SUMMARY OF THE INVENTION

In view of the above it is an object of the present invention to provide an improved method for producing a halogen lamp as well as to provide an improved halogen lamp.

According to the present invention this object is solved by methods comprising the features of patent claim 1 and/or by a halogen lamp comprising the features of patent claim 14.

Therefore it is provided:

- A method of producing a halogen lamp, comprising the following steps: Providing a glass tube blanket; dip-coating the glass tube blanket using a sol gel process with an inorganic coating; forming a lamp bulb from the coated glass tube blanket.
- A halogen lamp, in particular produced according to an inventive method, having a lamp bulb made of hard glass comprising an inorganic coating at least on its inner surface.

It is the gist of the present invention, instead of coating an almost completed halogen lamp or a completed lamp bulb in a subsequent manufacturing step in a conventional manner, to coat the glass tube blanket already provided for manufacturing the lamp yet before forming the lamp bulb, in other words directly at the beginning of the process of manufacturing the halogen lamp, by dip-coating using a sol gel process. Subsequently the coated glass tube blanket passes through the entire manufacturing process for forming a lamp bulb.

It is understood that a sol gel process is a method for producing non-metallic inorganic layers of so-called sols (dispersions).

It is understood that dip-coating using a sol gel process is a method at which the glass tube blanket is firstly dipped into a sol and then pulled out again. When pulling out, a film of the sol remains on the glass tube blanket. Particle growth and subsequent gelatinization of the film occurs by hydrolysis and condensation leading to a gel layer. After coating of the glass tube blanket the coating is turned into a ceramic by baking-out or tempering, in particular by pyrolysis (converting from organic to inorganic), leading to formation of certain crystal structures. The process may be repeated multiple times, in particular also by using different sols, enabling the structure or build-up of a multilayer system.

An inorganic coating is therefore meant to be particularly a ceramic coating which may comprise a plurality of single layers.

A glass tube blanket is meant to be a glass tube portion, which is in particular cylindrical. It is also contemplated that the glass tube portion comprises a curvature, a tapering or any other deformation, as long as it does not lead to a closure of the cavity within the glass tube blanket. The glass tube blanket may particularly be cut to the appropriate length required for the manufacturing process of forming a lamp bulb, provided as cut off pieces (a cut off piece is a so-called "Sprengling"). Alternatively, it may be contemplated to use a glass tube portion having the standard length of for example 1.2 meter which is normally supplied from a glass making plant. In this case, the glass tube portion having the standard length could be dip-coated and subsequently be cut to pieces having the appropriate length of the lamp bulb required for the manufacturing process. If for the process of manufacturing the lamp bulb portions are required which are uncoated, then these portions may be provided by locally removing the coating, for instance using etching by means of hydrofluoric acid.

According to the invention the glass tube blanket is dip-coated first and subsequently formed to a lamp bulb.

The process of forming a lamb bulb is particularly meant to be the entire further manufacturing process from the glass tube blanket to the completed lamp bulb. This comprises for example the introduction of electrical components as well as steps of forming the glass tube blanket being typically applied to the glass tube blanket while manufacturing a lamp bulb.

A lamp bulb is meant to be a glass bulb being sealed gas-tightly in which the electrical components of a halogen lamp are arranged, in particular a glow filament and its contacts. Preferably the contacts serve at the same time as a mechanical support for the glow filament. It is further preferred that the contacts (pins) are supported in a support section of the lamp bulb in which support section the lamp bulb is squeezed or crimped while being formed. Advantageously the lamp bulb further comprises a tip at its end opposing the support section. This tip may be formed by a pipette-like tapering of the glass tube blanket which is produced while forming the lamp bulb by locally heating and lengthening and which is subsequently cut through. Alternatively, the tip may be formed by attaching a so-called pumping tube which is melted onto the glass tube blanket.

The lamp bulb is filled with respective gases depending on the application of the halogen lamp, usually a mixture of inert gases and halogens, by means of the tip after cleaning and evacuating. Subsequently the tip is sealed with a glass drop, particularly in a last step of forming the lamp bulb.

Preferably, the glass tube blanket is made of hard glass. Hard glass is considered a high-grade colorless glass containing in particular metal oxides or ions as additives. The glass is characterized by high resilience to temperature changes and elasticity. With respect to its characteristics hard glass differs from conventional quartz glass. The most important characteristic of the hard glass in terms of the method according to the invention is characterized in that the hard glass is viscous within a very broad temperature range from 650° C. to 1300° C. in which range the hard glass may be deformed. However, for quartz glass this temperature range is relatively narrow and starts only at about 1500° C. An inorganic coating which is applied onto the glass tube blanket according to the inventive method would be destroyed at such high temperatures required for the deformation of quartz glass. Those high temperatures would in particular lead to a caking or sintering of the coating with the glass. Further, the process temperatures for quartz glass are high such that even the deformation of a non-coated section adjacent to the coating would damage the coatings or at least degrade them due to heat conduction or radiation. For this reason a coating may be applied to a lamp bulb made of quartz glass only subsequent to all deformation steps due to technological reasons.

Therefore, the invention provides the technological advantage of a glass tube blanket made of hard glass, in particular consisting of hard glass, such that processing of an already coated glass tube blanket to a lamp bulb is possible due to the lower temperatures required for forming of the glass.

According to the inventive method it is further advantageously possible to provide a coating of the lamp bulb in a single method step not only on the outer surface but also simultaneously on the inner surface. Therefore, twice a number of coatings of the lamp bulb may be provided for the same number of coating steps during manufacturing. Accordingly, the doubled number of layers increases the effectiveness of the coatings such that an improved effectiveness is achieved in total. Advantageously, significantly increased reflection factors (coefficients) or absorption factors are achievable, for example for the same layer thickness and the same number of single layers of a multilayer system.

According to the invention it is further possible to provide the coating on the inner surface in a predefined extent or height. This may be achieved by dipping the glass tube blanket in the sol and applying a low pressure (vacuum) in the cavity of the glass tube blanket such that the sol rises within the cavity. By adapting the low pressure the desired height of the coating of the inner surface may be precisely adapted.

According to this method it is further possible to provide the coating not only on the inner surface without coating the outer surface. For this, the glass tube blanket is only dipped into the sol with an initial portion of the glass tube blanket, which does not provide a functionally relevant portion of the subsequent lamp bulb and which is subsequently preferably cut through while forming a tip of the lamp bulb. Subsequently, a low pressure is applied to within the cavity of the glass tube blanket such that the sol is rising in the cavity. Therefore, only the inner surface of the glass tube blanket may be provided with a coating at functionally relevant portions of the glass tube blanket.

In the case of an infrared radiation reflecting coating, a coating on the inner surface of the lamp bulb has the advantage that infrared rays impinge directly on the coating without having to pass the wall of the lamp bulb first. It is therefore an advantage that an unwanted offset of rays due to refraction does not occur. It is also an advantage that no attenuation due to absorption occurs. Such an offset of rays may cause unwanted multiple reflections within the lamp socket which multiple reflections always lead to losses due to inadvertent absorption losses. On the other hand a reflection of infrared rays due to a coating on the inner surface leads to a back reflection of the infrared rays directly onto the glow filament, as is desired. Losses due to multiple reflections may thus be avoided.

Furthermore, the coating of the inner surface is advantageously protected by the lamp bulb against external impacts such that for example a scratching of the coating is impossible.

Advantageous implementations and further embodiments result from the further dependent claims as well as the specification with respect to the figures of the drawing. According to an embodiment the glass tube blanket is suspended for dip-coating and dipped into a sol such that an end portion of the glass tube blanket remains uncoated. The suspending of the glass tube blanket is preferably implemented by use of a grabber which grabs the glass tube blanket at the end portion. The dipping is performed only up until a predetermined depth such that the end portion is not being dipped into the sol. Therefore, an uncoated end portion is preferably made which may be deformed in the subsequent manufacturing process during forming of the lamp bulb without any problems, and in particular without any formation of bubbles or foam ("Läuter").

According to a preferred embodiment electrical components of the halogen lamp are introduced into the glass tube blanket for forming the lamp bulb and are melted portionwise into the uncoated end portion of the glass tube blanket. Preferably, the melting-in is performed by squeezing the uncoated end portion of the glass tube blanket to a support portion. This is particularly preferable since a formation of foam (so-called "Läuter") is thus avoided which would otherwise occur with the presence of a coating in the squeezed portion. The support portion has therefore an advantageous high mechanical stability which would not be ensured at formation of bubbles or foam. This is in particular a necessary characteristic for halogen lamps for the automotive field since in terms of mechanics the support portion is relatively strongly stressed by vibrations and so on. Therefore, the mechanical reliability and the stability of the halogen lamp are improved.

Within this context it is noted that the coating of the inner surface in the area of the tip of the lamp bulb does not interfere with the manufacturing since a squeezing does not take place at the tip which is why there is no danger of formation of bubbles. Further, the area of the tip is mechanically almost not stressed or strained such that possible inclusions are uncritical in terms of the operational stability. Possible optical imperfections in the area of the tip may be avoided, in particular with respect to automotive applications, by blackening the area of the tip of the lamp bulb using a dark cap which is provided by a dark surface paint.

According to a preferred embodiment the glass tube blanket is made of hard glass. Thereby, the forming of the lamp bulb may be performed preferably at comparatively low temperatures in the range of 650° C. and more. Therefore, the forming of the lamp bulb may be performed without damaging the inorganic coating in the functionally relevant portions of the coating. The functionally relevant portions of the coating are located in particular between the support portion and the area of the tip, with the area near the glow filament being particularly functionally relevant.

According to a further embodiment a low pressure is generated within the cavity of the glass tube blanket for coating the inner surface of the glass tube blanket such that a sol predetermined for the sol gel process arises up until a predetermined extent or height within the cavity. Advantageously the predetermined height may be thus achieved by adapting the low pressure. Furthermore, in this way a coating may be achieved which is predetermined to be on the inner surface only. For this, the glass tube blanket is dipped into the sol only in the initial area which does not serve as a functionally relevant area of the subsequent lamp bulb. Thus, by applying the low pressure the sol rises only in the cavity of the glass tube blanket such that only the inner surface is provided with a coating. The initial portion may particularly provide the area which is later, subsequent to forming a tip, cut through by means of a tapering.

According to an embodiment the coating is applied both on the inner surface and the outer surface of the glass tube blanket during dip-coating. Advantageously a double number of coatings is therefore provided through which rays are passing emitted during operation of the halogen lamp. The effects of the coating on the inner surface and on the outer surface of the lamp bulb accumulate accordingly. Advantageously significantly increased factors of reflection or, in case of absorption layers, significantly increased factors of absorption may be achieved thereby for the same layer thickness or for the same number of single layers depending on the type of coating for the case of reflection layers.

According to a preferred embodiment the coating applied during dip-coating comprises an infrared radiation reflecting coating. Advantageously, a large part of the infrared radiation power emitted from the glow filament is thus back-reflected during operation of the halogen lamp thereby achieving an increase in temperature of the glow filament. Advantageously this leads to an increase of the luminous flux and therefore to an increase of the efficiency of the lamp. In other words, the same luminous power as compared to a conventional halogen lamp may be achieved at lower electrical power input which advantageously saves energy. Further, the often unwanted warming-up of the environment for halogen incandescent lamps is reduced since less infrared radiation is emitted through the lamp bulb.

According to a preferred embodiment the dip-coating of the glass tube blanket by means of a sol gel process comprises the build-up of an alternating layer system. Such alternating layer systems are also referred to as multi-layers or interference layers. These are characterized by two different types of single layers comprising high and low refraction indices which are alternatingly applied on top of each other or stacked. With such alternate layer systems effective infrared reflecting coatings may be constructed which form a reflection band in the range of the infrared radiation and if necessary in addition to the red color range. Such alternating layer systems may comprise between two and sixty layers wherein significant reflection factors may be achieved by using a number of as small as five single layers. By using a number of ten to twelve single layers, reflection factors in the range of as low as 50 to 60% may be accomplished. By using thirty single layers, reflection factors of almost 100% may be implemented. An alternating layer system using five layers has thus a total thickness of about 300 nm up to 400 nm. An alternating layer system using thirty single layers has a thickness of approximately three microns. Therefore, a technically reasonable range of an alternating layer system is in the range between five and thirty single layers corresponding to a thickness of 0.3 μm to 3 μm.

In preferred embodiments, in particular if the coating is applied both on the inner surface and on the outer surface of the glass tube blanket, between four and twenty single layers are provided, with the total thickness of such an alternating layer system being for example one micron to two microns. Due to the double number of effective single layers by coating of the inner surface and the outer surface, a very high reflection factor is thus provided. Therefore, a particularly advantageous ratio is achieved between the effort of manufacturing a halogen lamp and the effect of the coating. Furthermore, the coatings may also be made thinner. Thinner coatings have a better adhesion on the lamp bulb than thicker coatings. Therefore, an improved adhesion of the layers may be achieved at a comparable reflection factor.

In one embodiment the alternating layer system comprises single layers of silicon oxide (SiOx) and titanium oxide (TiOx) in an alternating fashion. Alternatively or in addition alternating layer systems may also comprise niobium oxide (NbOx), tantalum oxide (TaOx) or zirconium oxide (ZrOx). Each single layer may comprise a different thickness, in particular at least a thickness of 30 to 40 nm and a maximum thickness of 200 to 240 nm. An average single layer thickness is preferably in the range of 100 nm to 120 nm. By varying the layer thicknesses the reflection characteristics of the alternating layer system may be controlled or adapted, particularly depending on the wavelength to be reflected.

According to an alternative embodiment the dip-coating of the glass tube blanket using a sol gel process comprises the application of at least one transparent layer having infrared rays reflecting nano pigments. This may preferably comprise a single layer having a comparatively large thickness of one micron to three microns, which may be achieved by a high pull out speed. The transparent matrix of the layer contains preferably silicon oxide and thus preferably provides a glass matrix. This matrix is preferably manufactured in a single dip-coating process by means of a silicate sol comprising the further contained nano pigments.

According to one embodiment the dip-coating of the glass tube blanket by means of a sol gel process comprises the application of an absorption layer. The absorption layer is particularly provided for dying the lamp bulb and may be applied optionally or additionally to an anti reflection layer. The absorption layer for instance may be made of cobalt/aluminum oxide ($CoAl_2O_3$) for achieving a blue coloration. Multiple other colorations are also possible, for example a red coloration by using iron oxide ($Fe_3O$). Such colorations may be used for special applications of halogen lamps, for example for brake lights, indicator lights or for a "xenon effect" at headlights for automotive vehicles.

According to a preferred embodiment the sol gel process comprises a pulling-out process of the step of pulling-out the glass tube blanket from the sol. Preferably a relative humidity of the ambient air is provided or adjusted between 30 and 70%. With such a humidity of the air a particularly uniform or homogeneous layer build-up is possible during the pulling-out process. Furthermore, the achieved layer thickness may be controlled by variation of the pulling-out speed.

According to a further advantageous embodiment the sol gel process comprises a tempering process in which the glass tube blanket pulled-out from the sol is exposed to a bake-out temperature of between 250° C. and 550° C. The aim of the tempering process is the pyrolysis, which is the transformation of organic components to inorganic components, wherein certain crystal structures are formed. In this way, during the tempering process the coating is baked to a ceramic. This process would not work below 250° C. Temperatures above 550° C. are not necessary since at this stage a complete and efficient pyrolysis is already occurring. Therefore, a preferred temperature range for the tempering process is between 500° C. and 550° C.

In a preferred embodiment of a halogen lamp the lamp bulb comprises the inorganic coating both on its inner surface and on its outer surface. The inorganic coating is preferably an infrared radiation reflecting coating. Alternatively or in addition an absorption layer may be provided, in particular for dying the lamp bulb.

In a preferred embodiment the halogen lamp further comprises a lamp socket in which the lamp bulb is supported or fixed. This is particularly common for automotive applications. Herein sockets for all halogen lamp vehicle standards may be contemplated. Alternatively the lamp bulb may also be designed for reception in a different holder, for example for use in household lights. For this, in particular only the pins of the halogen lamp may be deformed according to a household light standard (for example IEC 60061-1), for example as a pin socket (so-called Bipin) or squeeze socket. Alternatively an additional lamp socket may also be provided for household lights (as for example for the GU-10 standard).

In one embodiment the tip of the lamp bulb may be blackened by using a surface paint, in particular for halogen lamps for vehicle headlights.

In a further embodiment the glow filament of the halogen lamp may be parallel or coaxial to the bulb axis of the lamp bulb. However, the invention is not limited to this. For example, a glow filament being transversal to the lamp axis may also be provided.

The inventive halogen lamp is preferably produced according to an inventive method. Therefore, all features of a halogen lamp, which are disclosed herein with reference to a method for producing a halogen lamp as above, are also subject of the inventive halogen lamp and vice versa.

The above implementations and further embodiments may be combined with each other at will, as long as it is sensible. Further possible implementations, further embodiments, and arrangements of the invention also comprise not explicitly mentioned combinations of features herein disclosed with respect to exemplary embodiments of the present invention. In particular, the person skilled in the art will appreciate to add single aspects as improvements or additions to the respective basic form of the present invention.

BRIEF DESCRIPTION OF THE DRAWINGS

For a more complete understanding of the disclosure, reference should be made to the following detailed description and accompanying drawings, wherein.

Figure 1:
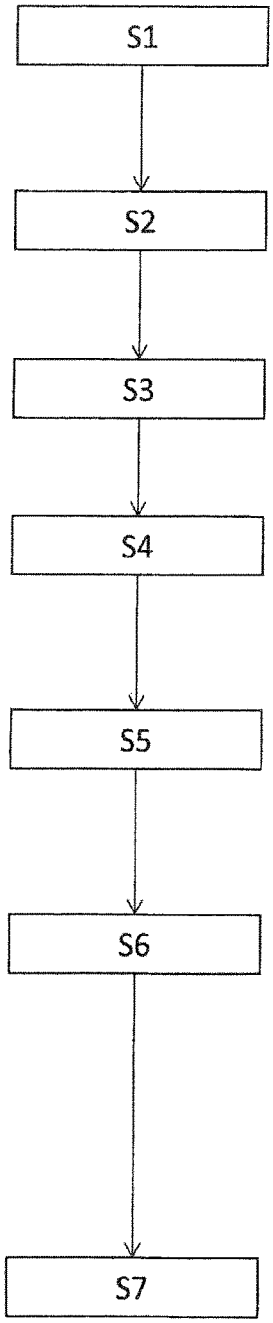
FIG. 1 shows a method for producing a halogen lamp.

The accompanying figures of the drawing should provide a more complete understanding of the embodiments of the present invention. The figures illustrate embodiments and serve to explain the principles and concepts of the invention in conjunction with the disclosure. Other embodiments and many of the mentioned advantages result in view of the drawings. The elements of the drawings are not necessarily shown to scale with respect to each other.

In the figures of the drawing like reference numerals refer to like parts, features, and components having the same functionality and operation unless it is stated otherwise.

DESCRIPTION OF EXEMPLARY EMBODIMENTS

FIG. 1 in conjunction with FIGS. 2*a* to 2*d* shows a method for producing a halogen lamp which is known to the inventor. The method comprises steps S1 to S7. Herein the individual steps are explained with respect to FIGS. 2*a* to 2*g* which illustrate the respective state of the individual method steps during the production.

Figure 2A:
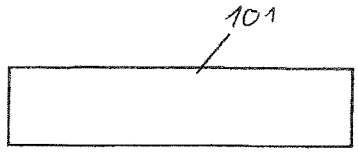
FIG. 2*a* shows a glass tube blanket.
Figure 2B:
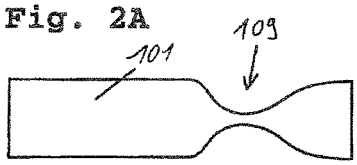
FIGS. 2*b*-2*e* show steps of forming a lamp bulb from a glass tube blanket according to FIG. 2*a;*

First step S1 refers to providing a glass tube blanket as is shown in FIG. 2*a*. The glass tube blanket 101 of FIG. 2*a* is made of for instance quartz glass or hard glass and is constructed as a circular hollow body illustrated in FIG. 2*a* in a side view. The length of the glass tube blanket 101 is already cut to the length required for producing a lamp bulb 103. Such an appropriate length is for example 8 cm. A glass tube blanket 101 which is thus cut to the correct length for producing a lamp bulb 103 is referred to as "sprengling" (i.e. a cut off piece).

Subsequent step S2 comprises the introduction of a pipette-like tapering 109 into the glass tube blanket 101. The tapering 109 is achieved by locally annealing and simultaneously lengthening the glass tube blanket 101 in the area which is provided for the tapering 109. Thereby, the diameter is greatly reduced locally, for example to a constant inner diameter of 1 millimeter, creating a tapered portion also referred to as capillary.

Figure 2C:
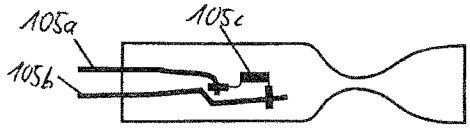

In the next step S3 electrical components of the halogen lamp 110 to be completed are introduced into the cavity of the glass tube blanket 101 at the end of the glass tube blanket 1 opposite the tapering or capillary 109, as is shown in FIG. 2*c*. The electrical components comprise two contact pins 105*a* and 105*b* as well as a glow filament 105*c* electrically connected in between.

Figure 2D:
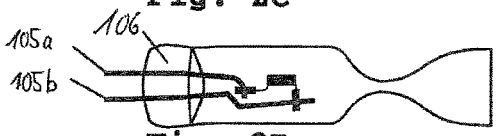

In the subsequent step S4 the electrical components are, as is illustrated in FIG. 2*d*, melted with the glass tube blanket 101 by crimping the end of the glass tube blanket 101 opposite the capillary to a support portion 106. For the glass tube blanket 101 made of quartz glass this is typically performed at temperatures in a range between 1500° C. and 1600° C. By this crimping step, the glass tube blanket is gas-tightly sealed in the area of the support portion 106 on the one hand, and on the other hand the pins 105*a* and 105*b* are fixedly mounted therein.

After the crimping step and in a subsequent step, which is not disclosed here in detail, the lamp bulb 103 which is now formed into its basic shape is firstly purged with a gas for cleaning and is then evacuated. Thereafter the bulb is filled with a predetermined gas filling which typically contains mainly inert gases as well as halogen additives.

Figure 2E:
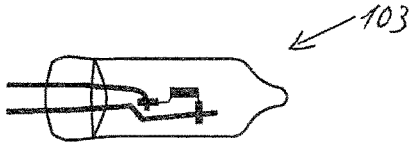

In a last forming step S5 the capillary is then cut at its narrowest position and is sealed gas-tightly using a glass drop such that the state illustrated in FIG. 2*e* of a completely formed lamp bulb 103 is achieved. In this condition the lamp bulb 103 could already been used in a halogen lamp.

Figure 2F:
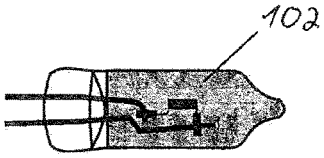
FIG. 2*f* shows a lamp bulb which is coated on the outside.
Figure 2G:
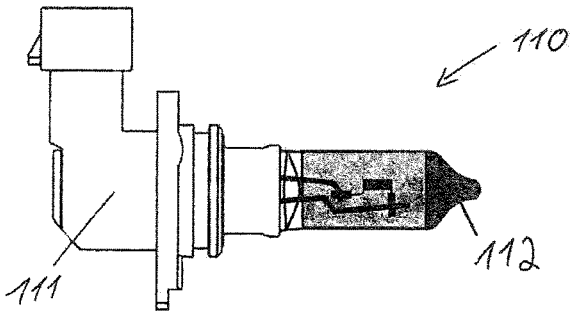
FIG. 2*g* shows a halogen lamp comprising a lamp bulb according to FIG. 2*f;*

To increase the efficiency of a halogen lamp or to modify the spectrum or the color of the light emitted from the halogen lamp the completed lamp bulb 103 may be coated additionally using a coating 102, as is illustrated in FIG. 2*f*. Such a coating may for instance be applied using a PVD method (physical vapor deposition) on the exterior of the lamp bulb 103 or may be vapor-deposited.

The lamp bulb 103 which is finalized in such a manner may then be processed in a subsequent step S7, for instance into an automotive halogen lamp 110, or may be assembled into a completed halogen lamp for a different field of application by mounting the lamp bulb 103 to a lamp socket 111. In addition, the lamp bulb 103 may be blackened at the tip by using a black colored surface paint 112.

As an alternative to step S7 the lamb bulb 103, after being completed in step S6, may for example be prepared for use in household lights by suitably forming the pins 105*a*, 105*b* to be received in a household lamp socket.

Figure 3:
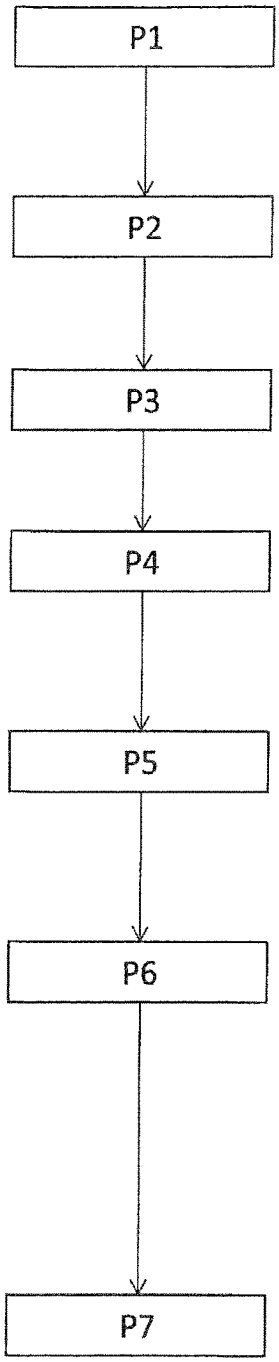
FIG. 3 shows a method for producing a halogen lamp according to the present invention.

FIG. 3 shows a method for producing a halogen lamp according to the present invention. The inventive method comprises steps P1 to P7, wherein the individual steps are explained herein in detail with reference to FIGS. 4*a* to 4*g* illustrating the respective producing state of the individual steps.

Figure 4A:
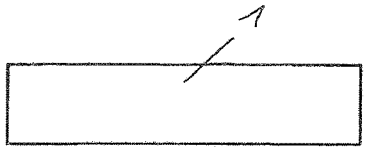
FIG. 4*a* shows a glass tube blanket.
Figure 4B:
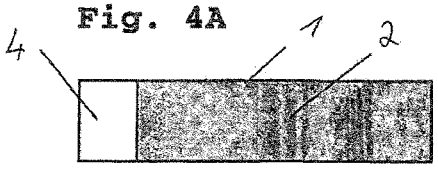
FIG. 4*b* shows a dip-coated glass tube blanket according to the present invention.

In a first step P1 a glass tube blanket 1 is provided, as is shown in FIG. 4*a*. In contrast to the glass tube blanket 101 of FIG. 2*a*, this glass tube blanket 1 of FIG. 4*a* is not made of quartz glass, but is made of hard glass. The external or geometric shape of the glass tube blanket 1 is identical to the shape of the glass tube blanket 101 of FIG. 2*a*.

In a subsequent step P2 the glass tube blanket 1 is coated by using a sol gel process using an inorganic coating 2. To perform this step the glass tube blanket 1 is suspended first by grabbing the glass tube blanket 1 in an area of an end portion 4 by means of a grabber. Then the glass tube blanket 1 is dipped into a sol by using the grabber, however, without the end portion 4 being dipped as well. The end portion 4 of the glass tube blanket 1 therefore remains uncoated.

Figure 8:
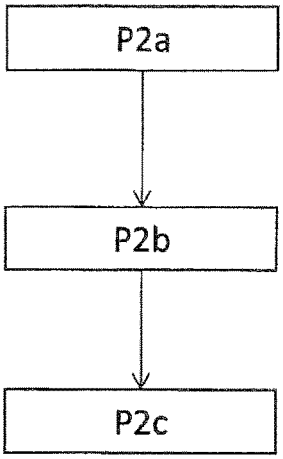
FIG. 8 shows the steps of dip-coating a glass tube blanket using a sol gel process.

Step P2 further comprises a pullout step of pulling out the glass tube blanket from the sol leading to a gel film, as well as a tempering step for firing or baking the layer into a ceramic, wherein the layer is applied by being dipped into the sol. With reference to FIG. 8 these individual steps will be explained in more detail below.

Subsequent to step P2 a glass tube blanket is thus provided which is coated with a ceramic layer. If multiple layers are to be provided, for example in the form of an alternating layer system, step P2 may be repeated multiple times. With respect to an alternating layer system this is performed using different sols for producing different individual layers of the coating 2 which will be explained in more detail with reference to FIG. 6.

Figure 4C:
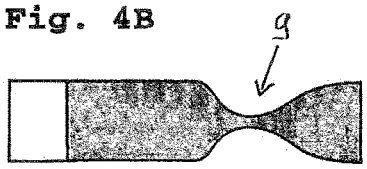
FIGS. 4*c*-4*f* show steps of forming a lamp bulb from the coated glass tube blanket of FIG. 4*b;*

In step P3 subsequent to step P2 the glass tube blanket 1 is provided with a tapering 9, as is illustrated in FIG. 4C. Again, this is performed by locally annealing and lengthening. However, in contrast to FIG. 2*b* where step S2 is achieved, this is performed at a glass tube blanket 1 made of hard glass and already coated using an inorganic layer at significantly lower temperatures in the range of 1100° C. to 1300° C.

In subsequent step P4 electrical components of the halogen lamp to be completed are introduced into the cavity of glass tube blanket 1, in analogy to step S3 according to FIG. 1. This is performed at the end opposite to tapering 9 at which end the uncoated end portion 4 is provided. The electric components comprise two contact pins 5*a* and 5*b* as well as a glow filament 5*c* being electrically connected in between the two contact pins of which are arranged coaxially to the axis of the glass tube blanket 1 or the later to be finished lamp bulb 103, respectively.

Figure 4D:
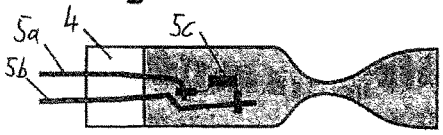
Figure 4E:
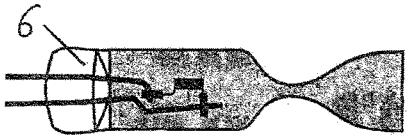

In subsequent step P5 the electrical components are melted section-wise into the glass tube blanket 1, as is illustrated in FIG. 4*d*. Herein it is important that for melting the electrical components only the uncoated end portion 4 of the glass tube blanket 1 is crimped or pressed into a support portion 6. Since the glass tube blanket is made of hard glass, this may be performed at temperatures starting from 1100° C. Thus, it is avoided that the coating is damaged at the coated portion. Due to the absence of a coating in the uncoated end portion 4, formation of bubbles or a foaming of the glass material is further avoided during crimping.

Subsequent to step P5 and in analogy to step S4 the bulb created by crimping is cleaned, evacuated, and filled with gas.

Then the capillary is cut in the area of the tapering 9 in a subsequent step P6 which is the last step of forming the lamp bulb 3, and is leak tightly sealed using a glass drop. The state thus achieved is illustrated in FIG. 4*f*.

By mounting on a lamp socket the further processing to achieve a halogen lamp is now performed in step P7, in analogy to step S7. For example, this may be a lamp socket for an automotive application. Additionally, a black surface paint 12 may be provided at the tip of the lamp bulb for avoidance of undefined light emission.

Figure 4F:
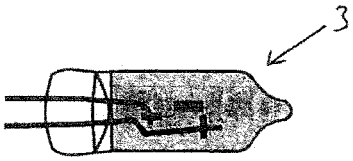
Figure 4G:
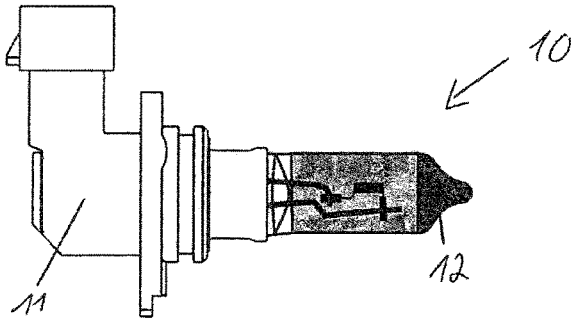
FIG. 4*g* shows a halogen lamp comprising a lamp bulb of FIG. 4*f* according to the present invention.

Also in analogy to step S7, a lamp bulb according to FIG. 4*f* may be deformed at its pins such that the lamp bulb corresponds to a conventional household lamp standard, as an alternative to step P7.

Figure 5:
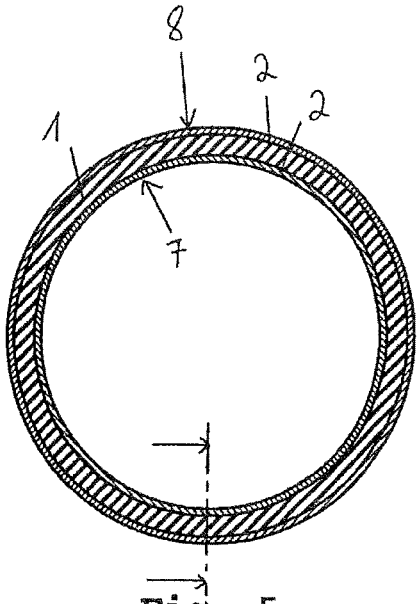
FIG. 5 shows a schematic cross-section view of a dip-coated glass tube blanket according to the present invention.

With respect to FIG. 5 a cross-section view of a coated glass tube blanket 1 is shown according to the present invention. The glass tube blanket 1 is provided with an inorganic coating 2 both on its inner surface 7 and on its outer surface 8, respectively. Such a coating both on the inner surface 7 and on the outer surface 8 is provided using dip-coating of the glass tube blanket 1 by means of a sol gel process. The inorganic coating 2 may be constructed in different ways and may have different functionalities.

A particularly advantageous functionality of halogen lamps is the provision of a reflection band for infrared light. Such a layer which reflects infrared light may be implemented for example by using a system of alternating layers.

Figure 6:
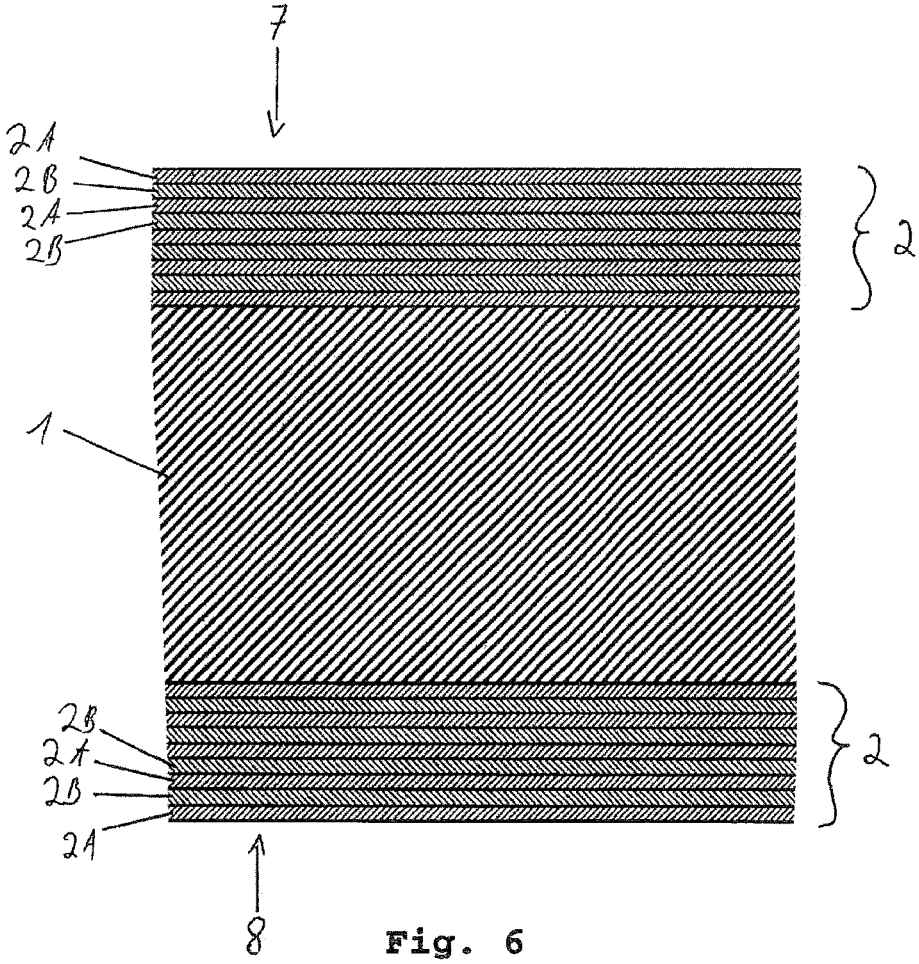
FIG. 6 shows a schematic cross-sectional view taken along the line illustrated in FIG. 5.

FIG. 6 shows a schematic cross-section view along the cross-section line (longitudinal cross-section) illustrated in FIG. 5, in the case of such an alternating layer system.

Accordingly, the glass tube blanket 1 has an inorganic coating 2 on its inner surface 7 and on its outer surface 8, respectively, the coating of which has been formed with an alternating layer system. The alternating layer system comprises two different types of single layers 2*a* and 2*b* having different refractive indices, respectively, in particular a high refractive index and a low refractive index. For example, the first type of single layers 2*a* provides a silicon oxide layer and the second type of single layers 2*b* provides a titanium oxide layer.

With reference to the exemplary embodiments illustrated, a total of nine single layers are provided on the inner surface 7 and on the outer surface 8, respectively, with a silicon oxide layer 2*a* and a titanium oxide layer 2*b* consistently alternating and stacked on top of each other. Such an alternating layer system is manufactured by repeating the dip coating using a sol gel process multiple times with different sols, that means in the exemplary case a total of nine times.

With reference to FIG. 8 the steps of dip-coating P2*a* to P2*c* of a glass tube blanket 1 are illustrated in detail using a sol gel process.

In a first step P2*a* the glass tube blanket which is suspended for example by using a grabber is dipped into a sol. This is preferably performed such that an end portion 4 of the glass tube blanket 1 remains uncoated. For precisely adjusting the extent or height of the coating 2 within the inner cavity of the glass tube blanket 1 a low pressure may be adjusted in the inner cavity of the glass tube blanket 1 to achieve a predetermined height of the coating 2 on the inner surface 7.

In a second step P2*b*, illustrating a pull out action, the glass tube blanket 1 is pulled out from the sol. It is important at this step that the relative humidity of the ambient air is between 30% and 70% in order to achieve a consistent or homogeneous coating. Further, the layer thickness gradient may be adjusted by varying the pull out speed.

After the pullout step a sol film is provided on the glass tube blanket, which is dried during and after the pulling out. Meanwhile a hydrolysis and condensation reactions of components of the sol (so-called precursor molecules) are performed until a gel layer is formed from the sol film.

In a third step P2*c* the coating is tempered. This means that organic components are transformed into inorganic component. This occurs at bake-out temperatures of between 250° C. and 550° C. wherein best results are achieved at temperatures of between 500° C. and 550° C.

With continued reference to FIG. 6 an alternating layer system may be implemented by multiply repeating the dip-coating using the sol gel process with different sols. For this, the different sols are utilized for each repeating step in an alternating manner such that the different single layers 2*a* and 2*b* are created alternatingly. This is repeated so many times until the desired number of single layers or until the desired total layer thickness is achieved. Higher reflective factors may be achieved by providing more single layers 2*a*, 2*b*.

Figure 7:
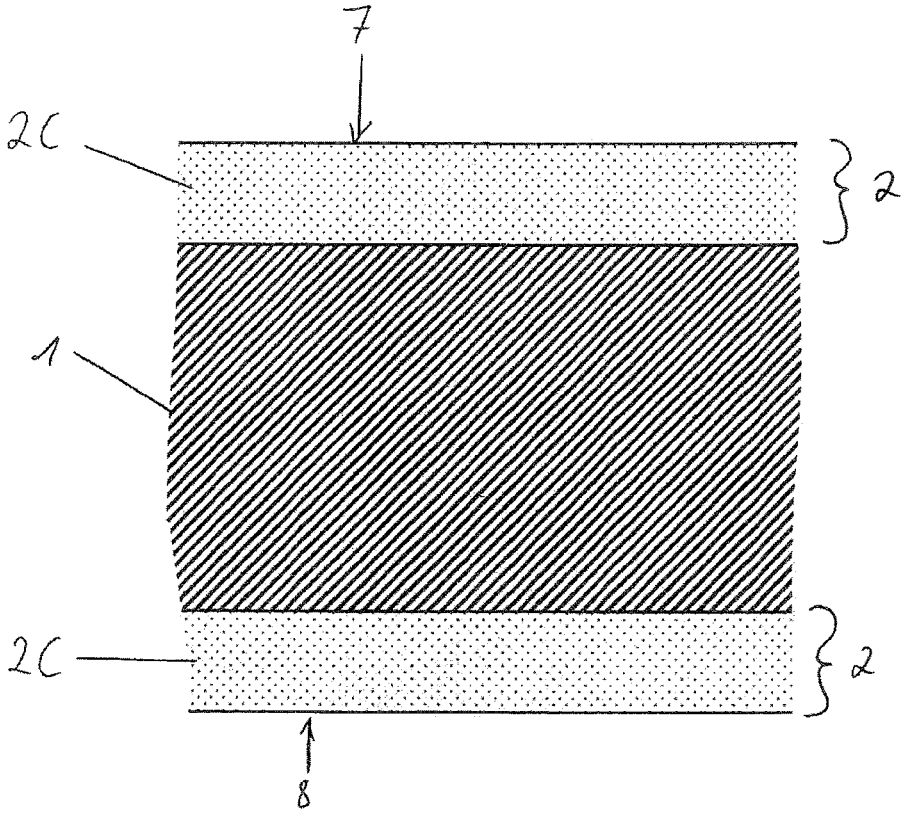
FIG. 7 shows a cross-sectional view according to FIG. 6, illustrating an alternative layer structure.

FIG. 7 shows a cross-section view of a glass tube blanket having an alternative layer structure similar to the one of FIG. 6. In the case of FIG. 7 the glass tube blanket 1 has a transparent layer 2*c* comprising infrared radiation reflecting nano pigments on its inner surface 7 and on its outer surface 8, respectively, which are schematically indicated by the dots of layers 2*c*. Such nano pigments are disclosed for example in DE 10 2005 061 684 A1.

In order to apply the layer 2*c* using a sol gel process the nano pigments are provided in a sol in combination with precursors, which are provided for and suitable for forming a transparent layer. The precursors for forming a transparent layer comprise preferably silicates or silicon oxide, in other words a silicate sol. By a singular dip-coating step according to a method of FIG. 8 a layer 2*c* is applied on the glass tube blanket. Preferably this layer has a relatively large thickness of 1 micron to 2 microns which may be simplified by a pull out process having a relatively high pull out speed.

Although the present invention is described with respect to preferred exemplary embodiments herein, the invention is not limited thereto and may be modified in numerous ways.

In addition, meanwhile an absorption layer may be provided in the exemplary embodiments according to FIG. 6 or 7 above or below the infrared radiation reflecting layer which may cause a coloration of the lamp bulb for exam-le.

Furthermore, a purely absorbing coating may be provided as an alternative coating 2 instead of one of the coatings illustrated in FIG. 6 or FIG. 7.

Still further, the glow filament 5*c* in the lamp bulb 3 may also be positioned in a different manner, for instance parallel to the bulb axis, angled or transverse to the bulb axis.

LIST OF REFERENCE NUMERALS AND SIGNS

1 glass tube blanket
2 coating
2*a* first single layer
2*b* second single layer
2*c* transparent layer having infrared radiation reflecting nano pigments
3 lamp bulb
4 uncoated end portion
5*a*, 5*b* contact pins
5*c* glow filament
6 support portion
7 inner surface
8 outer surface
9 tapering or capillary
10 halogen lamp
11 lamp socket
12 black surface paint
101 glass tube blanket
102 coating
103 lamp bulb
105*a*, 105*b* contact pins
105*c* glow filament
106 support portion
109 tapering or capillary
110 halogen lamp
111 lamp socket
112 black surface paint
S1-S7 method steps
P1-P7 method steps

The invention claimed is:

1. A method of producing a halogen lamp, the method comprising:

providing a glass tube blanket;

dip-coating the glass tube blanket using a sol gel process having an inorganic coating;

forming a lamp bulb from the coated glass tube blanket.

2. The method of claim 1, wherein the glass tube blanket is suspended and dipped in the sol for dip-coating such that an end portion of the glass tube blanket remains uncoated.

3. The method of claim 2, wherein electrical components of the halogen lamp are introduced into the glass tube blanket for forming the lamp bulb and are melted portion-wise in the uncoated end portion of the glass tube blanket.

4. The method of claim 1, wherein the glass tube blanket is made of hard glass.

5. The method of claim 1, wherein a low pressure is generated in the inner cavity volume of the glass tube blanket for coating the inner surface of the glass tube blanket such that a sol determined for the sol gel process rises up until a predefined extent within the cavity.

6. The method of claim 1, wherein the coating is applied during dip-coating both on the inner surface and on the outer surface of the glass tube blanket.

7. The method of claim 1, wherein the coating applied during a dip-coating comprises a coating reflecting infrared radiation.

8. The method of claim 7, wherein the dip-coating of the glass tube blanket using a sol gel process comprises a structure of an alternating layer system, which comprises in particular between 5 and 30 single layers and having a thickness of 0.3 μm to 3 μm.

9. The method of claim 7, wherein the alternating layer system alternately comprises single layers having a high and low refraction index.

10. The method of claim 7, wherein the dip-coating of the glass tube blanket using a sol gel process comprises applying at least a transparent layer having nano pigments reflecting infrared radiation.

11. The method of claim 1, wherein the dip-coating of the glass tube blanket using a sol gel process comprises applying an absorption layer.

12. The method of claim 1, wherein the sol gel process comprises a pull out step of the pulling out of the glass tube blanket from the sol, at a relative humidity of the ambient air between 30% and 70%.

13. The method of claim 1, wherein the sol gel process comprises a tempering step in which the glass tube blanket pulled out from the sol is exposed to a bake-out temperature between 250° C. and 550° C.

* * * * *